United States Patent [19]

Sullivan

[11] Patent Number: 5,071,027

[45] Date of Patent: Dec. 10, 1991

[54] CONVECTOR TRAY FOR A FAN COIL UNIT

[76] Inventor: John T. Sullivan, 3910 Madison St., Hyattsville, Md. 20781

[21] Appl. No.: 681,234

[22] Filed: Apr. 5, 1991

[51] Int. Cl.[5] ..... B65D 1/10

[52] U.S. Cl. ..... 220/571; 62/291

[58] Field of Search ..... 220/571; 62/291, 150

[56] References Cited

U.S. PATENT DOCUMENTS

| | | | |
|---|---|---|---|
| 1,808,234 | 6/1931 | Kohn | 220/571 |
| 4,712,382 | 12/1987 | LeClear | 62/291 |
| 4,733,790 | 3/1988 | Stein | 220/571 |
| 4,856,672 | 8/1989 | Sullivan | 220/571 |

*Primary Examiner*—Joseph Man-Fu Moy

*Attorney, Agent, or Firm*—Diller, Ramik & Wight

[57] ABSTRACT

A condensation tray includes a central main tray body formed from extruded polymeric/copolymeric material and includes a bottom wall and opposite upstanding side walls. The bottom wall includes inner and outer surfaces and condensation channels/chambers therebetween. A coil sitting upon the bottom wall inner surface operating in the air conditioning mode creates condensation from the ambient air within the condensation channels/chambers which collects therein, flows outwardly therefrom into one or two of opposite injection molded end caps bonded to the central main tray body. Condensate eventually passes through a discharge port of the end caps(s) to a drain, and in this manner condensation will not adversely effect the fan coil unit, its components, or the environs thereof, such as an adjacent rug, ceiling or the like.

24 Claims, 4 Drawing Sheets

CONVECTOR TRAY FOR A FAN COIL UNIT

BACKGROUND OF THE INVENTION

Residential and commercial air conditioners include as a part thereof a fan coil unit. The fan coil unit includes a coil through which coolant (liquid or gas) is pumped, and normally the coil is spaced above or seated in a convector tray or condensation tray or pan in which condensation collects as air passes through the coil. The condensate which collects in the condensation tray is conducted by an appropriate outlet(s) and pipe(s) to a conventional drain.

Such condensation trays are generally made from galvanized metal and rust with relative ease. Disadvantages of the latter and the manner in which the same are overcome through the construction of an in situ vacuum molded polymeric/copolymeric condensation tray are set forth in U.S. Pat. No. 4,856,672 dated Aug. 15, 1989 in the name of John Sullivan. Additional novel and unobvious condensation pans/trays or convector trays are disclosed in U.S. Pat. No. 4,986,087 issued on Jan. 22, 1991 in the name of John Sullivan.

A problem unmentioned in the latter-identified patents is particularly common in condensation trays of the type in which the coil rests upon a bottom wall of the condensation tray. In such case the tray, and particularly the bottom wall of both a metallic and a plastic tray, will become cool through conduction from the coil when operating in the air conditioning mode. Surrounding ambient air collects upon the exterior surface of the condensation tray, particularly the exterior surface of the bottom wall thereof. This condensation collects, drips from the tray, and can damage interior mechanical (rust) and electrical (shorts) components of the fan coil unit. Adjoining areas can also be damaged as such condensation inevitably leaks outwardly from the fan coil unit to adjacent living areas. For example, it is not uncommon to see condensation stains adjacent fan coil units which most commonly rest on floors adjacent and beneath windows of motels. In hotels, the fan coil units are at times mounted in the ceiling of a hotel room and the dripping condensation forms highly visible stains in the ceilings. Accordingly, the damage created by condensation is not only functional damage with respect to the fan coil unit, but also aesthetic damage imparted to surrounding areas.

SUMMARY OF THE INVENTION

In keeping with the present invention, a condensation tray or convector tray is provided for fan coil units of air conditioners/ heat exchangers and includes an elongated tray body in which a bottom wall has interior and exterior surfaces and between the latter surfaces are one or more channels or chambers for collecting condensation. When a coil resting upon the inner surface of the bottom wall is operating in the air conditioning mode, conduction cools the bottom wall and particularly the area most immediate the inner surface. Ambient air in the condensation channel(s) or chamber(s) condenses and can eventually be properly discharged into a drain to thereby prevent the adverse effects earlier noted.

In further accordance with the invention, the bottom wall, and preferably opposite side walls, are of an extrusion molded construction which allows for the relatively rapid and relatively inexpensive manufacture of this component of the overall condensation tray. End walls or end caps are then secured to opposite axial ends of the bottom wall in such a manner that the condensation from the condensation collection chamber(s) or channel(s) will drain into the area of the end walls or end caps and eventually be discharged therefrom.

Preferably, the end walls or end caps are injection molded and can include a drain discharge opening, outlet or port. In this manner the bottom wall and the side walls thereof can be of a simple, straightforward extruded construction and only the end walls or end caps need be specifically designed for condensation discharge, but the latter is easily accommodated by constructing these through an appropriately designed injection mold.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
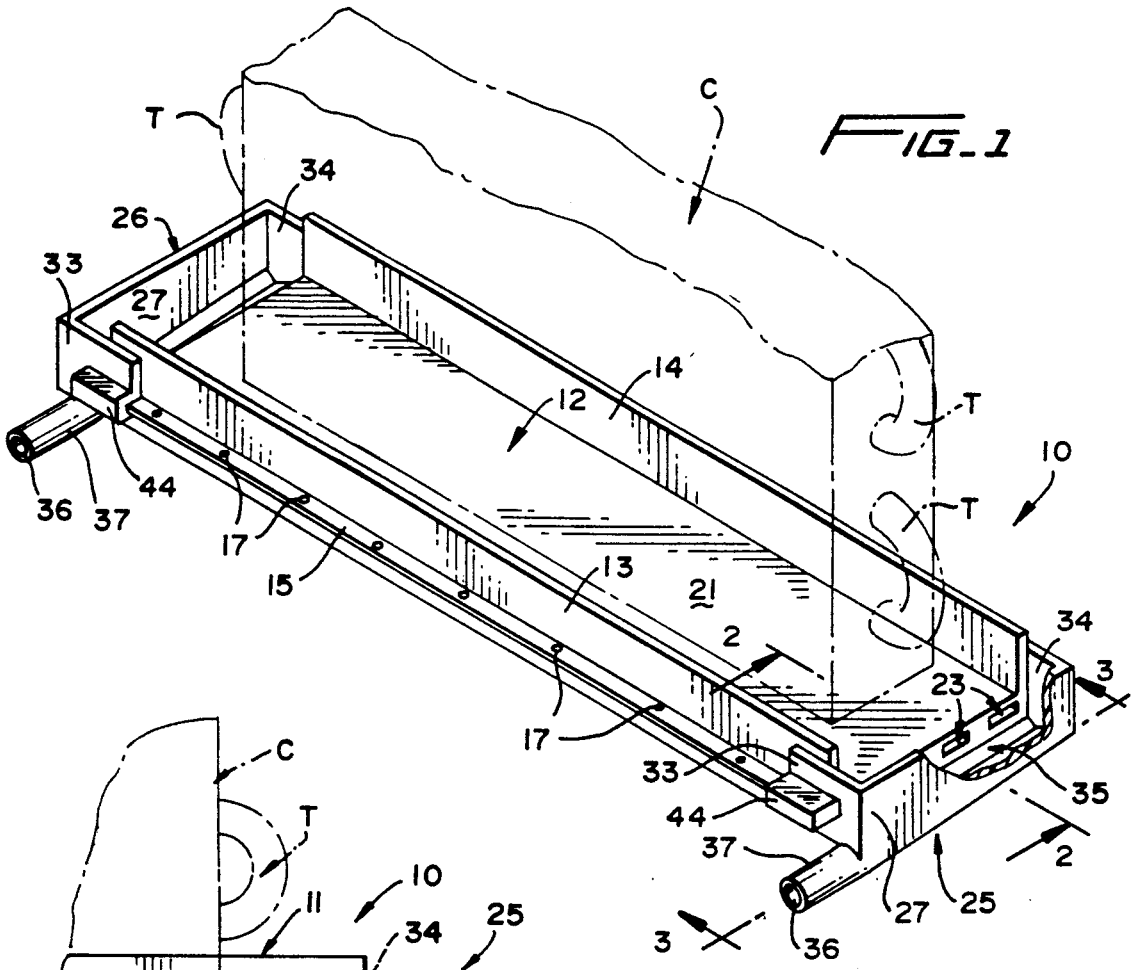
FIG. 1 is a perspective view of a novel condensation pan/tray or convector pan/tray constructed in accordance with this invention, and illustrates an injection molded central main tray body having a plurality of condensation channels/chambers, opposite tray end caps or walls closing the central main tray body, and in phantom outline a coil resting upon an inner surface of a bottom wall of the main tray body.
Figure 2:
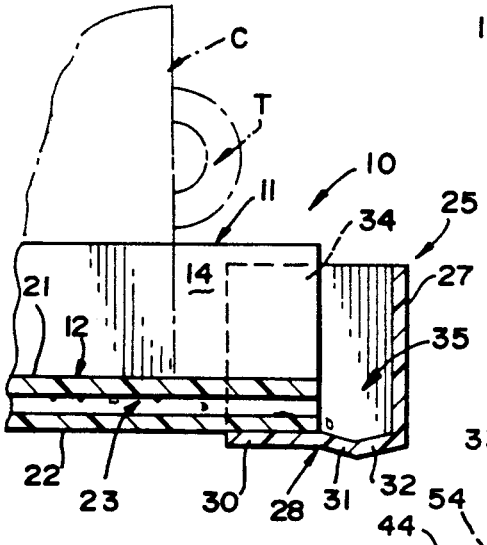
FIG. 2 is an enlarged fragmentary cross-sectional view taken generally along line 2—2 of FIG. 1, and illustrates the manner in which condensation collects in one of the condensation chambers/ channels and drips into one of the tray end caps for eventual discharge to a drain.
Figure 3:
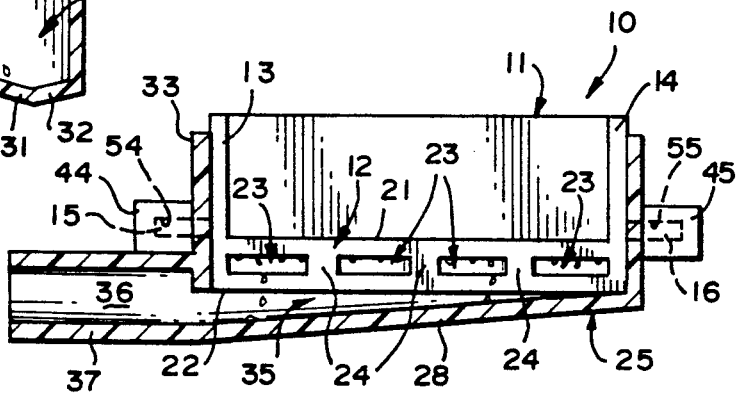
FIG. 3 is an enlarged cross-sectional taken generally along line 3—3 of FIG. 1, and illustrates the manner in which condensation collected in the tray end cap is discharged to a drain through a discharge port or outlet.

A novel condensation pan/tray or convector pan/-tray constructed in accordance with this invention is illustrated in FIGS. 1 through 3 of the drawings and is generally designated by the reference numeral 10. The tray 10 is shown associated with a conventional coil F having fins (not shown) and tubing T through which a refrigerant, such as Freon, flows when operating in either the air conditioning or heating mode, and it is during the operation of the air conditioning mode that the present invention is particularly directed, as it will appear more fully hereinafter.

The condensation tray 10 includes a central main tray body 11 defined by a bottom wall 12 and opposite generally parallel side walls 13, 14. A mounting and aligning flange 15 runs the length of the side wall 13 and projects outwardly and normal therefrom, and a like mounting and aligning flange 16 (FIG. 3) similarly projects normal and outwardly from the side wall 14 and runs the length thereof. Both of the mounting and aligning flanges 15, 16 have a series of holes or openings 17 therethrough.

The bottom wall 12 includes an inner surface 21 (FIGS. 2 and 3), an outer surface 22, and a plurality of condensation channels or chambers 23 running the length of the bottom wall 12, and opening outwardly thereof at each of longitudinally opposite end faces (unnumbered). The condensation channels or chambers 23 are separated from each other by bridging walls or ribs 24. The surfaces 21, 22 are illustrated as being generally parallel to each other, but the relative relationship therebetween can be varied, as will be noted more fully hereinafter, and the same is true of the generally rectangularly shaped condensation channels or chambers 23.

The entire central main tray body 11 is formed by conventional extrusion molding from polymeric/-copolymeric plastic material. Such materials as high-impact polystyrene, flexible polyethylene or impact-resistant ABS are suitable materials from which the central main tray body 11 can be injection molded. Equally capable of being injection molded is a glass-reinforced vinyl composition manufactured and sold by B. F. Goodrich Company under the trademark "Fiberlock" which incorporates both the strength and rigidity of metal parts, yet is lightweight and has high chemical resistance. B.F. Goodrich Company also produces its trademarked "Geon" vinyl which is also suitable for extrusion molding. Whatever the material, the extrusion nozzle simply has the overall transverse cross-sectional configuration (FIG. 3) of the bottom wall 12 and the side walls 13, 14 and four generally rectangular cores (not shown) associated with the extrusion nozzle form the condensation channels/chambers 23 as an indeterminate length of thermoplastic is extruded. This indeterminate length is then simply transversely cut into whatever different length or lengths are required for a particular main tray body 11 of the condensation tray 10.

Means generally designated by the reference numerals 25, 26 in the form of tray end caps or tray end walls are provided for closing the normally open ends of the main tray body 11. Since the tray end caps 25, 26 are essentially identical, the description of the tray end cap 25 set forth immediately hereinafter is applicable to the tray end cap 26.

The tray end cap 25 includes an end wall 27 (FIGS. 1 and 2) side walls 33, 34 and a bottom wall 28 having a relatively flat bottom wall portion 30 (FIG. 2) and downwardly converging bottom wall portions 31, 32 (FIG. 2) which also taper downwardly from the side wall 34 toward the side wall 33 (FIG. 3) to define an upwardly opening trough 35 which opens into a passage 36 of a tubular condensation outlet or spout 37.

The side walls 33, 34 have respective generally hollow projections 44, 45 which open axially away from the end wall 27 and transversely toward each other to define respective slots 54, 55.

In order to assemble the central main tray body 11 to the tray end caps 25, 26, the slots 54, 55 of the respective projections 44, 45 of each of the tray end caps 25, 26 are aligned with and slipped upon the respective aligning flanges 15, 16 and slid forward relative to each other until the same bottom and further movement is precluded by the abutment of the end face (unnumbered and unillustrated) of the mounting and aligning flanges 15, 16 with the end walls (unnumbered) of the projections 44, 45, respectively. The latter limits end cap movement relative to the main tray body 11 and positions the trough 35 (FIG. 2) such that condensation forming and collecting in the channels 23 will drain into the trough 35 and from the latter outwardly through the spout 37. Sonic welding, suitable thermosetting adhesives, or the like can be utilized to effect a homogeneous leak-proof seal between each of the end caps 25, 26 and the main tray body 11.

When the coil C is operating in the air conditioning mode, relatively cold refrigerant (Freon) flows through the tubes T and in turn cools the bottom wall 12 through conduction because, as earlier noted, the bottom of the coil C rests directly upon the inner surface 21 of the bottom wall 12 (See FIG. 2). Warmer ambient air surrounds the condensation tray 10 including ambient air within the condensation channels/chambers 23 which is formed into condensation droplets eventually collecting within the channels 23 in sufficient amounts to form condensation which then flows outwardly of the channels 23 into the troughs 35 for subsequent discharge to a conventional drain through the condensation outlets or spouts 37. It should be particularly noted that since the condensation forms within the channels 23, it does not form along the outer surface 22 of the bottom wall 12 and, hence, damage earlier noted from such conventional formation of condensation and its dripping into/upon the fan coil unit, its components, and adjacent rug, ceiling, etc., is precluded by the present invention.

The condensation tray 10 has been illustrated with each tray and cap 25, 26 being provided with a condensation outlet spout 37. In this case it is assumed that the condensation tray 10 is disposed generally horizontally in the associated fan coil unit by fasteners passing through the mounting and aligning flange openings 17 which are in turn suitably secured to the framework of the fan coil unit. However, if the condensation tray 10 is inclined in one direction or other, only the lower one of the tray end caps 25, 26 need be provided with a condensation outlet spout 37.

Figure 4:
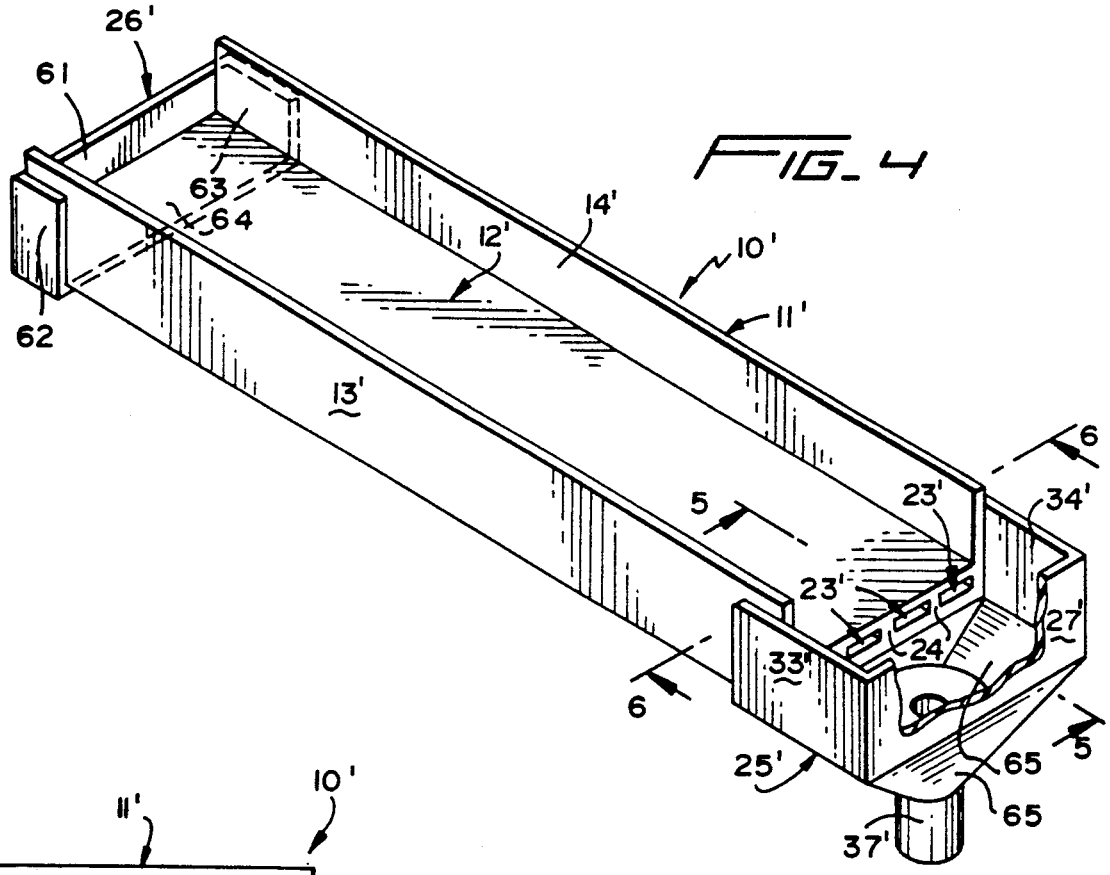
FIG. 4 is a perspective view with a portion thereof broken away for clarity of another condensation tray of the invention, and illustrates a central main tray body, opposite tray end caps or walls, and one of the tray end caps having a condensation discharge port formed therein.
Figure 5:
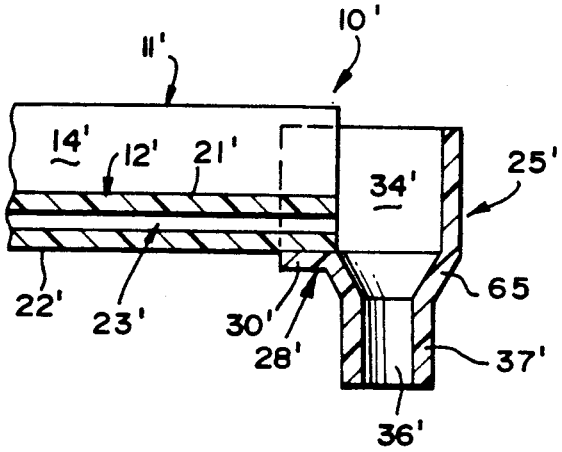
FIG. 5 is an enlarged fragmentary cross-sectional view taken generally along line 5—5 of FIG. 4, and illustrates details of the main tray body, and the associated tray end cap and its discharge port.
Figure 6:
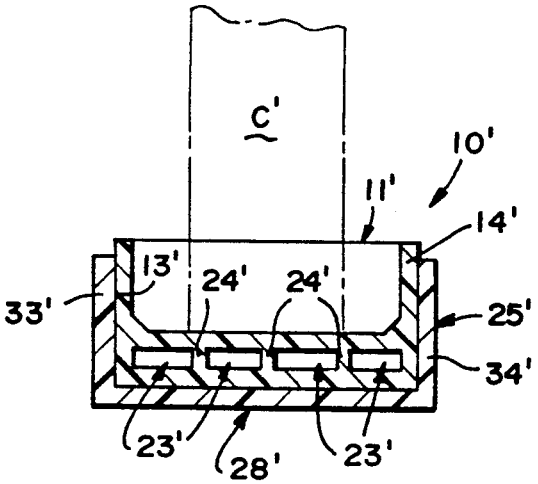
FIG. 6 is an enlarged cross-sectional view taken generally along 6—6 of FIG. 4, and illustrates details of the main tray body and the associated tray end cap.

Reference is now made to FIG. 4 which illustrates another condensation tray/pan or convector tray/pan which is similar to the condensation tray 10 of FIGS. 1 through 3 and is, therefore, identified by the reference numeral 10'. In this case a central main tray body 11' of the condensation tray 10' is identical to the central main tray body 11 of the condensation tray 10, except the flanges 15, 16 have been eliminated. Furthermore, a tray end cap or wall 26' does not include an outlet spout 37 but instead includes an end wall 61, opposite side walls 62, 63 parallel to each other and a bottom wall 64 parallel to the end wall 61 and the side walls 62, 63. The side walls 62, 63 snugly conform to exterior surfaces (unnumbered) of the main tray body side walls 13', 14' and a like relationship exists between an exterior bottom surface (unnumbered) of the bottom wall 12' and the bottom wall 64. The tray end cap 26' is, of course, hermetically sonically and/or adhesively secured to the central main tray body 11'.

An opposite tray end cap or wall 25' includes an end wall 27', side walls 33', 34', a bottom wall 28' having a flat bottom wall portion 30' and a generally centrally located vertical discharge passage 36' of a condensation outlet or spout 37' having a generally centrally located frusto-conical upwardly diverging funnel-like portion 65 which merges with the walls 27', 33' and 34'. The wall portion 30' and the walls 33', 34' are sonically or adhesively hermetically secured to the central main tray body 11'. The condensation tray 10' is particularly adapted for utilization with a fan coil unit which allows in-line vertical downward drainage of the condensation in one direction. Thus, the left-end of the condensation tray 10' is blind or closed by the tray end cap 26', and condensation which flows outwardly from the condensation channels or chambers 23' will discharge into the tray end cap 25'. Accordingly, when the condensation tray 10' is installed in a fan coil unit, it must be appropriately inclined to allow left-to-right condensation flow in the condensation channels 23'.

Figure 7:
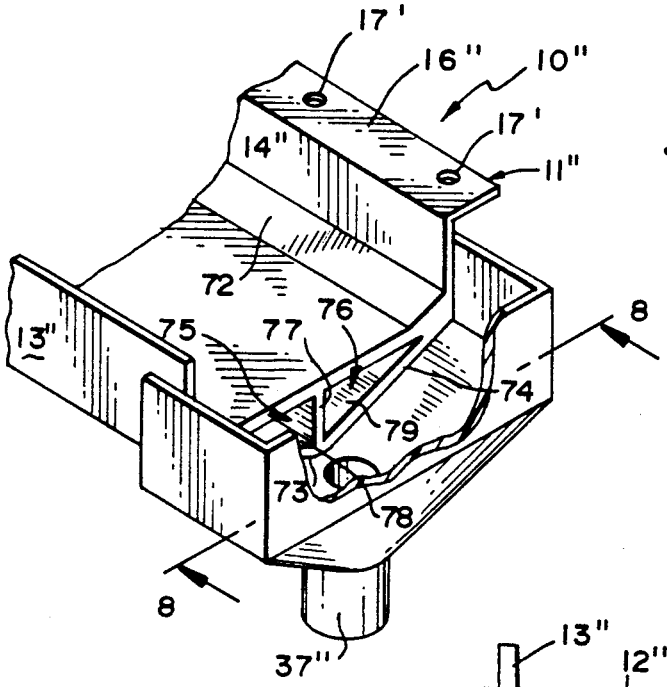
FIG. 7 is a fragmentary perspective view with a portion thereof broken away for clarity of another condensation tray constructed in accordance with this invention, and illustrates a central main tray body having a bottom wall with associated condensation chambers/channels having bottom converging surfaces to effect efficient drainage.
Figure 8:
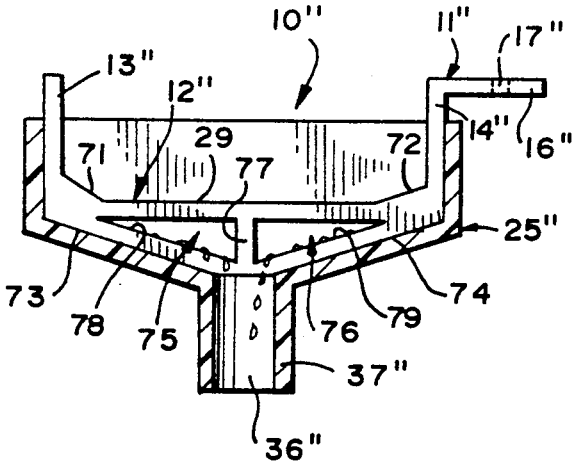
FIG. 8 is an enlarged cross-sectional view taken generally along line 8—8 of FIG. 7, and illustrates the details of the condensation chambers and the manner in which condensation flows therefrom into an associated discharge port.

Another condensation tray 10'' is illustrated in FIGS. 7 and 8 and includes a tray end cap or wall 25'' identical to the tray end cap 25' of FIG. 4. However, a central main tray body 11'' is somewhat different than the central main tray body 11' of FIG. 4. In this case, the central main tray body 11'' includes a bottom wall 12'', a side wall 13'', an opposite parallel side wall 14'', and the latter includes a mounting flange 16'' having mounting openings 17'' An inner central longitudinal bottom wall portion 21'' of the bottom wall 12'' merges at each of its longitudinal edges (unnumbered) with relatively converging surfaces 71, 72 (FIG. 8). A bottom surface of the bottom wall 12'' is defined by downwardly converging bottom surface portions 73, 74 and between the latter and the inner central longitudinal bottom wall portion 29 are a pair of condensation channels or chambers 75, 76 separated by a bridging wall or rib 77. The condensation channels 75, 76 are each of a generally transverse triangular cross-sectional configuration and include respective inclined walls 78, 79 which converge toward each other and toward a condensation passage 36'' of a condensation spout 37''. As is most readily apparent from FIG. 8, the surfaces 71, 72 and particularly the surfaces 73, 74 direct condensation toward a longitudinal center line of the central main tray body for collection and eventual discharge to a drain through the condensation spout 37''.

Figure 9:
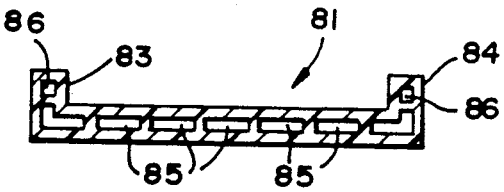
FIGS. 9 through 11 are reduced cross-sectional views taken through three different central main tray bodies illustrating a variety of cross-sectional configurations thereof, as well as associated condensation chambers/channels formed not only in a bottom wall but in upstanding side walls.
Figure 10:
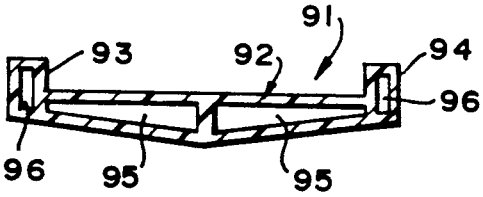
Figure 11:
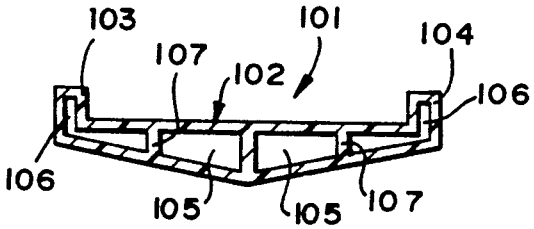

Reference is now made to FIGS. 9 through 11 of the drawings in which are illustrated central main tray bodies 81, 91, and 101, respectively. The central main tray bodies 81, 91 and 101 include bottom walls 82, 92, 102; side walls 83–84, 93–94, 103–104; and condensation channels or chambers 85–86, 95–96 and 105–106, respectively.

The central main tray body 81 essentially corresponds to the central main tray body 11 of FIG. 1, including the formation of the condensation channels 85 in the bottom wall 82. However, the side walls 83, 84 are also provided with the condensation channels or chambers 86 and condensate formed therein will discharge in the manner heretofore described into an associated tray end cap, such as the tray end cap 25 of FIG. 1. Utilization of the condensation channels 86 in the side walls 83, 84 further assures that as much condensation as might be formed will be collected and discharged to drain without adversely effecting any associated fan coil unit or the surrounding environs.

The central main tray body 91 of FIG. 10 corresponds in cross-section generally to the central main tray body 11'' of FIG. 7, but here again the side walls 93, 94 are provided with the condensation channels 96 to achieve maximum condensate collection.

The central main tray body 101 of FIG. 11 is similar to the central main tray body 91 of FIG. 10, except the condensation channels or chambers 106 of the side walls 103, 104 merge into the bottom wall 102 and are separated from the chambers 105 by bridging walls or ribs 107. This construction allows condensation in the side walls 103, 104 to flow downwardly and into the bottom wall 102 before longitudinally exiting the same.

Figure 12:
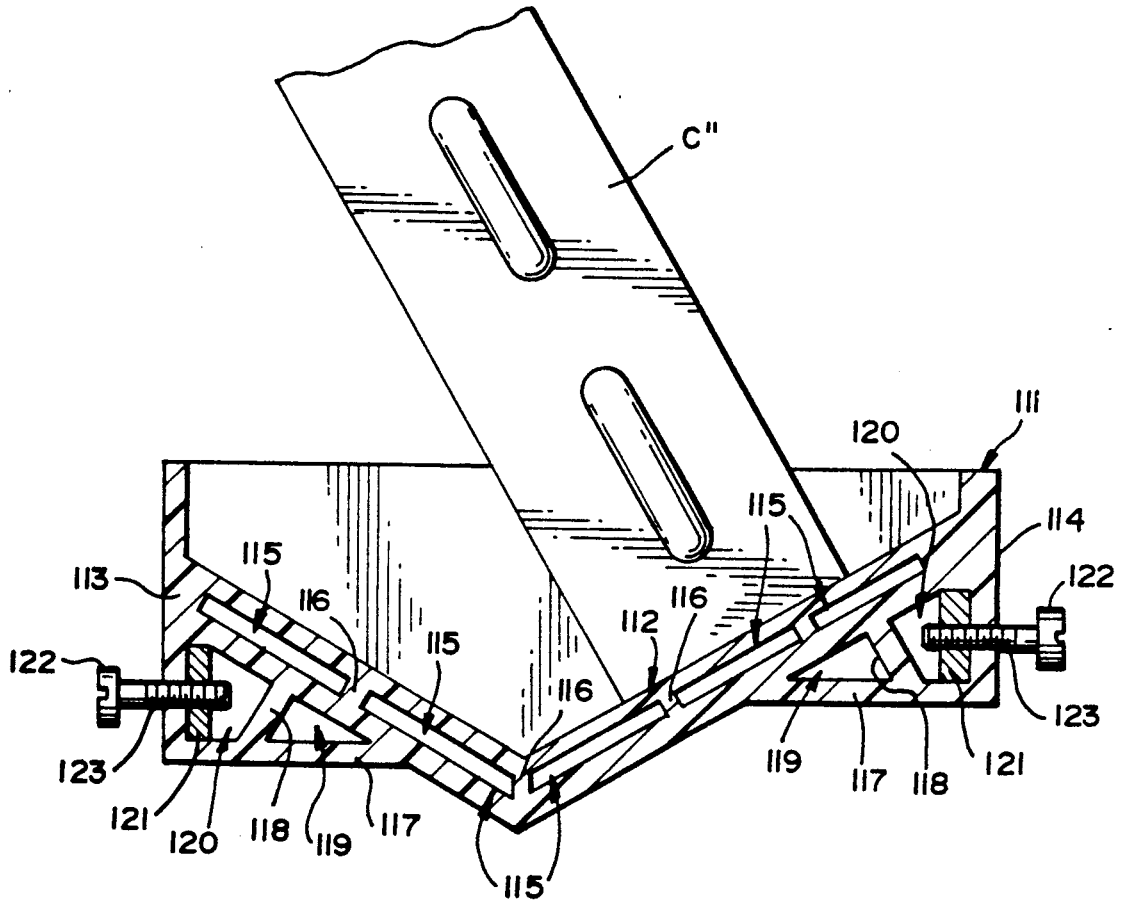
FIG. 12 is a fragmentary cross-sectional view taken through another central main tray body of a condensation tray of the invention, and illustrates the manner in which selected ones of the condensation chambers/channels accommodate square nuts for securing the central main tray body to an associated fan coil unit.

Another central tray body 111 is illustrated in FIG. 12 associated with a coil C'' supported upon an inner surface (unnumbered of a bottom wall 112 which is of a generally shallow V-shaped transverse cross-sectional configuration. The bottom wall 112 merges with side walls 113, 114 and includes condensation channels or chambers 115 separated from each other by bridging walls or ribs 116. A pair of walls 117 bridge between the side walls 113, 114 and the bottom wall 112. A bridging wall or rib 118 separates each of the areas between the walls 112, 113 and 117 and 112, 114 and 117 into two channels or chambers 119, 120, each of the latter of which can receive a square nut 121. A fastener 122 is passed through an opening (not shown) of the fan coil unit or the framework thereof and through an opening 123 in each of the walls 113, 114, and is threaded into the associated square nut 121 to removably secure the condensation tray (not shown) in the associated fan coil unit. Obviously, the central main tray body 111 is extrusion molded from polymeric/copolymeric plastic material in the manner heretofore described and is hermetically sonically or adhesively bonded/secured to appropriately contoured tray end caps or walls (not shown) to effect the intent of the present invention. Such tray end caps are preferably contoured to the entire exterior profile of the central main tray body 111 so that condensate will collect and flow thereinto not only from the condensation channels 115, but also from the channels 119, 120 should any condensate form therein.

Although a preferred embodiment of the invention has been specifically illustrated and described herein, it is to be understood that minor variations may be made in the apparatus without departing from the spirit and scope of the invention, as defined the appended claims.

I claim:

1. A tray for preventing the formation of condensation on at least one exterior surface thereof comprising a tray body including a bottom wall, said bottom wall having an interior surface and an exterior surface, and means for forming a condensation collection chamber between said interior and exterior surfaces within which condensation will form and collect due to a temperature differential between the condensation collection chamber and the exterior of said bottom wall.

2. The tray as defined in claim 1 wherein said bottom wall is of an extrusion molded construction.

3. The tray as defined in claim 1 wherein said bottom wall is of a polymeric/copolymeric extruded construction.

4. The tray as defined in claim 1 wherein said tray body includes at least one wall cooperative with said bottom wall for closing an end of said tray body.

5. The tray as defined in claim 1 wherein said tray body includes opposite end walls cooperative with said bottom wall for closing opposite ends of said tray body.

6. The tray as defined in claim 1 wherein said tray body includes at least one wall cooperative with said bottom wall for closing an end of said tray body, and said at least one wall is of an injection molded construction.

7. The tray as defined in claim 1 wherein said tray body includes opposite end walls cooperative with said bottom wall for closing opposite ends of said tray body, and said opposite end walls are each of an injection molded construction.

8. The tray as defined in claim 1 wherein said tray body includes at least one wall cooperative with said bottom wall for closing an end of said tray body, said at least one wall is of an injection molded construction, and ultrasonic bonding means for bonding said at least one wall to said bottom wall.

9. The tray as defined in claim 1 wherein said tray body includes at least one wall cooperative with said bottom wall for closing an end of said tray body, said at least one wall is of an injection molded construction, and adhesive bonding means for bonding said at least one wall to said bottom wall.

10. The tray as defined in claim 1 wherein said tray body includes opposite end walls cooperative with said bottom wall for closing opposite ends of said tray body, said opposite end walls are each of an injection molded construction, and ultrasonic bonding means for bonding at least one of said opposite end walls to said bottom wall.

11. The tray as defined in claim 1 wherein said tray body includes opposite end walls cooperative with said bottom wall for closing opposite ends of said tray body, said opposite end walls are each of an injection molded construction, and adhesive bonding means for bonding at least one of said opposite end walls to said bottom wall.

12. The tray as defined in claim 1 including means for discharging condensation from said condensation collection chamber.

13. The tray as defined in claim 1 including at least one end cap cooperative with said bottom wall for closing an end of said tray body.

14. The tray as defined in claim 1 including at least one end cap cooperative with said bottom wall for closing an end of said tray body, and said condensation collection chamber opens into said at least one end cap whereby condensation from said condensation collection chamber will flow into said at least one end cap.

15. The tray as defined in claim 1 including at least one end cap cooperative with said bottom wall for closing an end of said tray body, said condensation collection chamber opens into said at least one end cap whereby condensation from said condensation collection chamber will flow into said at least one end cap, and means for discharging condensation from said condensation collection chamber.

16. The tray as defined in claim 15 wherein said bottom wall is of an extrusion molded construction.

17. The tray as defined in claim 15 wherein said bottom wall is of a polymeric/copolymeric extruded construction.

18. The tray as defined in claim 15 wherein said at least one end cap is of an injection molded construction.

19. The tray as defined in claim 15 wherein said bottom wall includes at least a second condensation collection chamber, and said first-mentioned and second collection chambers are substantially in parallel relationship to each other.

20. A tray for preventing the formation of condensation on at least one exterior surface thereof comprising a tray body including bottom wall, said bottom wall having an interior surface and an exterior surface, means for forming a condensation collection chamber between said interior and exterior surfaces within which condensation will form and collect due to a temperature differential between the condensation collection chamber and the exterior of said bottom wall, said tray body further including a pair of side walls disposed in transverse relationship to and at opposite sides of said bottom wall, and means between at least a lower portion of one of said pair of side walls and said bottom wall exterior for receiving a fastener to thereby secure said tray to an associated fan coil unit.

21. The try as defined in claim 20 wherein said fastener receiving means is a chamber.

22. The tray as defined in claim 21 including a fastener in said chamber.

23. The tray as defined in claim 22 wherein said fastener is a nut.

24. The tray as defined in claim 22 wherein said fastener is a square nut.

* * * * *